US006299296B2

(12) United States Patent
Gasvoda

(10) Patent No.: US 6,299,296 B2
(45) **Date of Patent: *Oct. 9, 2001**

(54) SEALING MEMBER FOR A FLUID CONTAINER

(75) Inventor: Eric L. Gasvoda, Salem, OR (US)

(73) Assignee: Hewlett Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/126,908

(22) Filed: Jul. 31, 1998

(51) Int. Cl.[7] ..... B41J 2/175; E03B 65/20
(52) U.S. Cl. ..... 347/85; 137/614.2
(58) Field of Search ..... 347/85, 86, 87; 277/630, 634, 637, 644, 650; 141/329, 330, 2, 18; 137/614.2

(56) References Cited

U.S. PATENT DOCUMENTS 3,603,471 9/1971 Harris et al. ..... 215/37
5,523,780 * 6/1996 Hirosawa et al. ..... 347/86
5,751,322 5/1998 Miller et al. ..... 347/86
5,777,646 7/1998 Barinaga et al. ..... 347/86

FOREIGN PATENT DOCUMENTS 63-276554 * 11/1988 (JP) ..... 347/86

* cited by examiner

*Primary Examiner*—Judy Nguyen
(74) *Attorney, Agent, or Firm*—Kevin B. Sullivan

(57) ABSTRACT

The present disclosure relates to a sealing member for sealing an opening in a fluid container. The sealing member receives a hollow tubular member to establish communication between the hollow tubular member and the fluid container. The sealing member includes a resilient sealing portion configured to receive the hollow tubular member. With the hollow tubular member inserted through the resilient sealing portion a compressive seal is formed with an outer surface of the hollow tubular member to limit passage of fluid between the resilient sealing portion and the hollow tubular member. Also included is a lead-in portion on the resilient sealing portion. The lead-in portion guides the hollow tubular member through the resilient sealing portion to establish communication between the hollow tubular member and the fluid container.

6 Claims, 5 Drawing Sheets

SEALING MEMBER FOR A FLUID CONTAINER

BACKGROUND OF THE INVENTION

The present invention relates to ink-jet printing systems, and more particularly, ink-jet printing systems which make use of ink containers that are replaceable separate from a printhead.

Ink-jet printers frequently make use of an ink-jet printhead mounted to a carriage that is moved back and fourth across a print media, such as paper. As the printhead is moved across the print media, a control system activates the printhead to deposit ink droplets onto the print media to form images and text.

Previously used printers have made use of an ink container that is separably replaceable from the printhead. When the ink cartridge is exhausted the ink cartridge is removed and replaced with a new ink container. The uses of replaceable ink containers that are separate from the printhead allow users to replace the ink container without replacing the printhead. The printhead is then replaced at or near the end of printhead life and not when the ink container is exhausted.

There is an ever-present need for printing systems that are capable of providing low operating costs such as printers that make use of off-axis type ink supplies. In addition, these printing systems should be easy to operate, such as, including some form of memory for storing printing parameters so that the user is not required to adjust printer parameters when the ink container is replaced. These ink supplies should be capable of reliable insertion into the printing system to ensure that proper fluid interconnection and proper electrical interconnection with the printer is achieved. In addition, these interconnections should be reliable and should not degrade over time and use. For example, the fluid interconnect should not leak during use or over time and the electrical interconnect should be reliable during use and over time. In addition, these ink cartridges should not require special handling by the user and should be reliable and easily connected by the user to form a positive highly reliable mechanical, electrical, and fluid interconnect with the printer.

These ink containment systems should be capable of providing ink at high flow rates to a printhead thereby allowing high throughput printing. This ink supply system should be cost effective to allow relatively low cost per page printing. In addition, the ink supply should be capable of providing ink at high flow rates in a reliable manner to the printhead.

SUMMARY OF THE INVENTION

The present invention is a sealing member for sealing an opening in a fluid container. The sealing member receives a hollow tubular member to establish communication between the hollow tubular member and the fluid container. The sealing member includes a resilient sealing portion configured to receive the hollow tubular member. With the hollow tubular member inserted through the resilient sealing portion a compressive seal is formed with an outer surface of the hollow tubular member to limit passage of fluid between the resilient sealing portion and the hollow tubular member. Also included is a lead-in portion on the resilient sealing portion. The lead-in portion guides the hollow tubular member through the resilient sealing portion to establish communication between the hollow tubular member and the fluid container.

Another aspect of the present invention is an ink container for providing ink to an ink jet printing system. The ink jet printing system has a fluid inlet having a hollow needle that has a blunt end and a lateral hole. The ink container includes a first sealing surface for tightly receiving the hollow needle to prevent fluid passage between the hollow needle and the first sealing member when the ink container is in fluid communication with the ink jet printer. Also included is a second sealing surface for receiving a movable sealing member. The movable sealing member is biased against the second sealing member when the hollow needle is at least partially removed from the first sealing member. The second sealing surface is spaced sufficiently from the first sealing surface so that debris resulting from movement of the hollow needle relative to the first sealing surface does not prevent the movable sealing member from seating with the second sealing member. dr

DETAILED DESCRIPTION OF THE PREFERRED EMBODIMENT

Figure 1:
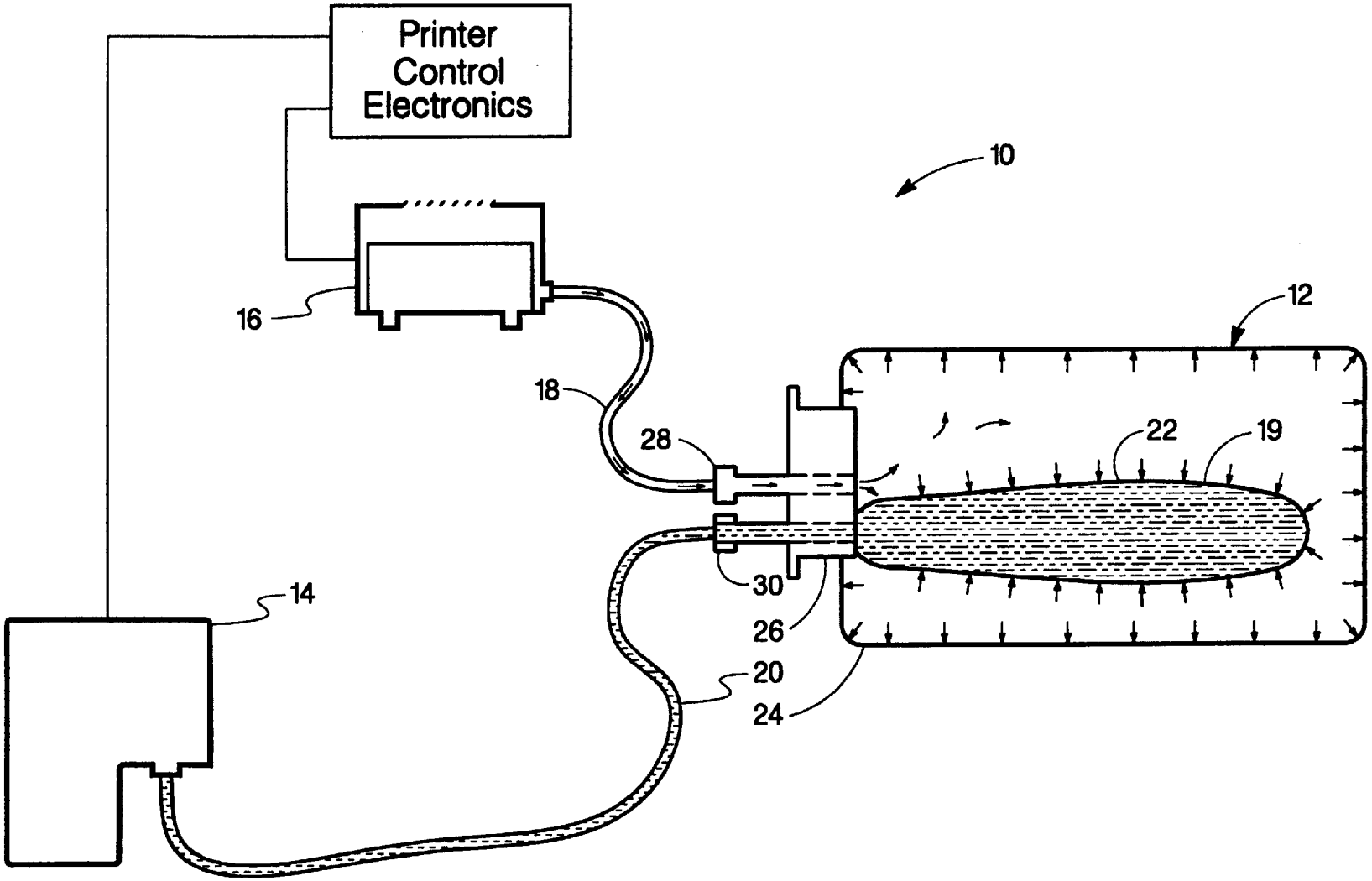
FIG. 1 depicts a schematic representation of a printing system that includes an ink container of the invention.

FIG. 1 depicts a schematic representation of a printing system 10 that includes the ink container 12 of the present invention. Also included in the printing device 10 are a printhead 14 and a source of pressurized gas such as a pump 16. The pump 16 is connected by a conduit 18 for providing a pressurized gas such as air to the ink container 12. A marking fluid 19 such as ink is provided by the ink container 12 to the printhead 14 by a conduit 20. This marking fluid is ejected from the printhead 14 to accomplish printing.

The ink container 12 which is the subject of the present invention includes a fluid reservoir 22 for containing ink 19, an outer shell 24, and a chassis 26. In the preferred embodiment the chassis 26 includes an air inlet 28 configured for connection to conduit 18 for pressurizing the outer shell 24 with air. A fluid outlet 30 is also included in the chassis 26. The fluid outlet 30 is configured for connection to the conduit 20 for providing a fluid connection between the fluid reservoir 22 and fluid conduit 20.

In the preferred embodiment the fluid reservoir 22 is formed from a flexible material such that pressurization of the outer shell produces a pressurized flow of ink from the fluid reservoir 22 through the conduit 20 to the printhead 14. The use of a pressurized source of ink in the fluid reservoir 22 allows for a relatively high fluid flow rates from the fluid reservoir 22 to the printhead 14. The use of high flow rates or high rates of ink delivery to the printhead make it possible for high throughput printing by the printing system 10.

The present invention is a method and apparatus for forming a reliable fluid interconnection between the ink container 12 and the printing system 10. More specifically, the fluid outlet 30 associated with the ink container 12 allows for fluids to be transferred in a reliable manner between ink container 12 and the printhead 14. In addition, the fluid outlet 30 also tends to prevent fluid from leaking from the from the ink container 12 when not connected to the printing system 10 such as during storage and transport. The fluid outlet 30 will be discussed in more detail with respect to FIGS. 3–7. Before discussing the fluid outlet in detail the overall printing system will be discussed with respect to FIG. 2.

Figure 2:
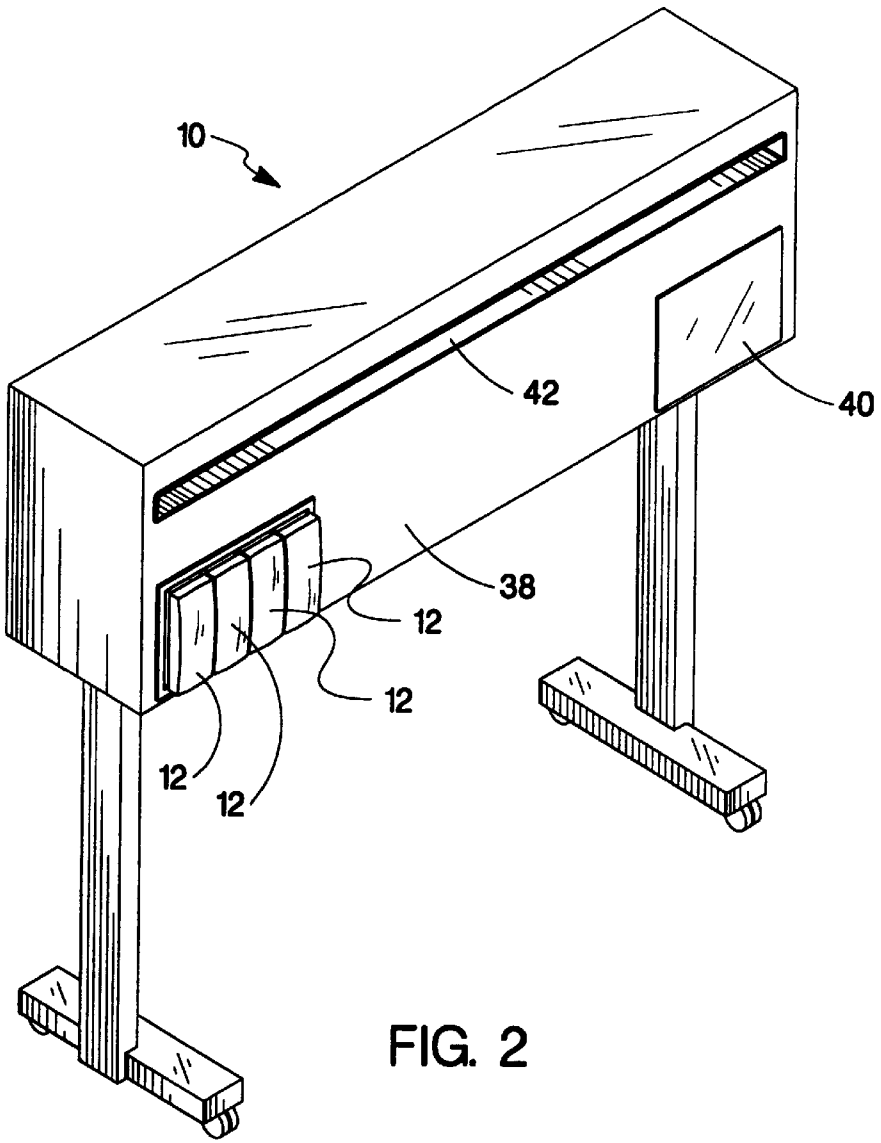
FIG. 2 depicts a perspective view of a representation of the printing system of FIG. 1.

FIG. 2 depicts one embodiment of the printing system 10 shown in perspective. The printing system 10 includes a printing chassis 38 containing one or more ink container 12 of the present invention. The embodiment shown in FIG. 2 is shown having four similar ink containers 12. In this embodiment, each ink container contains a different ink color. Therefore, four color printing is accomplished by providing cyan, yellow, magenta and black ink from the four ink containers 12 to one or more printheads 14. Also included in the printer chassis 38 is a control panel 40 for controlling operation of the printer 10 and a media slot 42 from which print media such as paper is ejected.

As ink 19 in each ink container 12 is exhausted the ink container 12 is replaced with a new ink container 12 containing a new supply of ink. In addition, the ink container 12 may be removed from the printer chassis 38 for reasons other than an out of ink condition such as changing inks for an application requiring different ink properties or for use on different media. It is important that the ink container 12 be not only accessible within the printing system 10 but also easily replaceable. It is also important that the replacement ink container 12 form reliable interconnects such as fluid interconnect, air interconnect and mechanical interconnect so that the printing system 10 performs reliably.

It is important that ink spillage and spattering be minimized to provide reliable interconnection between the ink container 12 and printer 10. Ink spillage is objectionable not only for the operator of the printer who must handle the spattered ink container 12 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

Figure 3:
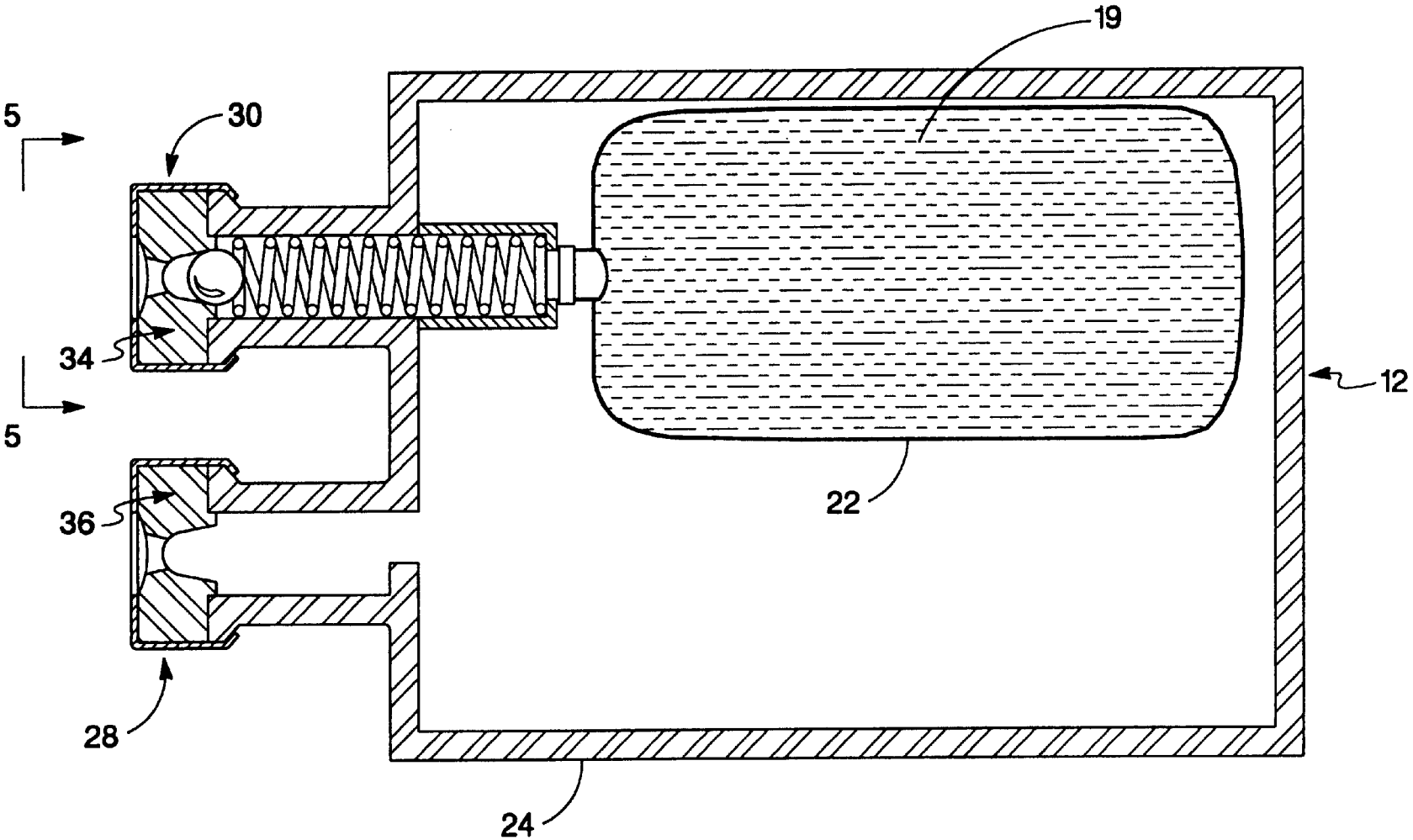
FIG. 3 depicts a representation of the ink container of FIG. 1 shown in section with the fluid out inlet shown greatly enlarged.

FIG. 3 depicts a simplified representation of the ink container 12 of the present invention show in section and disconnected from the printing system 10. The ink container 12 includes the fluid outlet 30, shown greatly enlarged, which is in fluid communication with the fluid reservoir 22 containing the supply of fluid 19. The ink container 12 further includes the air inlet 28 that is in communication with an area within the outer shell 24 and not within the fluid reservoir 22. The application of a pressurized gas, such as air, to this region allows pressurization of the ink container 12 for providing a source of pressurized fluid from the fluid outlet 30. The fluid outlet 30 and air inlet 28 of the present invention each include a sealing member 34 and 36 for sealing each of the fluid outlet 30 and air inlet 28, respectively, when the ink container 12 is not installed in the printer chassis 38 shown in FIG. 2. More specifically, the sealing member 34 prevents or limits ink leakage from the fluid outlet 30 when the ink container is not installed in the printer chassis 38. In addition, each sealing member 34 and 36 provides a seal between the fluid outlet 30 and a fluid inlet (not shown) associated with the printer chassis 38 and a seal between the air inlet 28 and an air outlet (not shown) associated with the printer chassis 38. The sealing members 34 and 36 tend to limit or prevent leakage of both air and ink when the ink container 12 is properly installed in the printer chassis 38. The sealing members will be discussed in more detail with respect to FIGS. 4–7.

Figure 4:
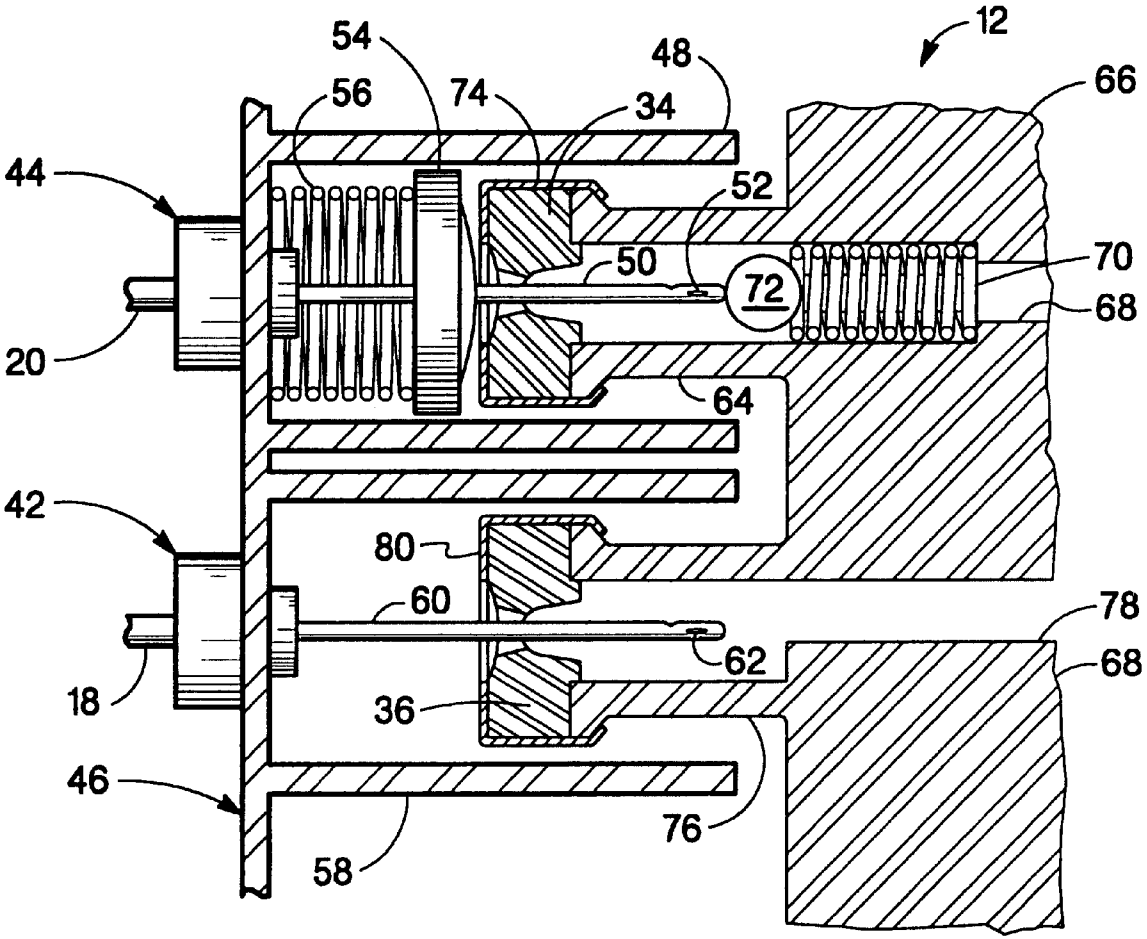
FIG. 4 depicts a cross section of a fluid outlet and an air inlet for the ink container of the present invention shown in engagement with a fluid inlet and air outlet, respectively associated with a printer portion.

FIG. 4 illustrates further detail of the preferred sealing member 34 and 36 associated with the fluid outlet 30 and air inlet 28, respectively, of the ink container 12. As shown in FIG. 4 the fluid outlet 30 and air inlet 28 is shown connected to a corresponding fluid inlet 44 and air outlet 42 associated with an ink container receiving station 46 on the printer chassis 38.

In this preferred embodiment the fluid inlet 44 associated with the ink container receiving station 46 includes a housing 48 and outwardly extending needle 50 having a closed, blunt upper end, a blind bore (not shown) and a lateral hole 52. The blind bore is fluidly connected to the lateral hole 52. The end of the needle 50 opposite the lateral hole 52 is connected to the fluid conduit 20 for providing ink to the printhead 14 shown in FIG. 1. A sliding collar 54 surrounds the needle 50 and is biased upwardly by spring 56. The sliding collar 54 has a compliant sealing portion with an exposed upper surface and an inner surface in direct contact with the needle 50.

The air outlet 42 on the ink container receiving station 46 is similar to the fluid inlet 44 except does not include the sliding collar 54 and the spring 56. The air outlet 42 on the ink container receiving station 46 includes a housing 58 and an outwardly extending needle 60 having a closed, blunt upper end, a blind bore (not shown) and a lateral hole 62. The blind bore is fluidly connected to the lateral hole 62. The end of the needle 60 opposite the lateral hole 62 is connected to the air conduit 18 for providing pressurized air to the ink container 12 shown in FIG. 1.

In this preferred embodiment, the fluid outlet 30 associated with the ink container 12 includes a hollow cylindrical boss 64 that extends outward from an ink container chassis 66. The end of the boss 64 toward the chassis 66 opens into a conduit 68 which is fluidly connected to the ink reservoir 22 thereby providing fluid to the fluid outlet 30. A spring 70 and sealing ball 72 are positioned within the boss 64 and held in place by a sealing member such as compliant septum 34 and a crimp cover 74. The spring 70 biases the sealing ball 72 against the septum 34 to form a fluid seal preventing fluid leakage from the ink container 12 when the ink container is removed from the receiving station 46. In addition, the sealing member 34 forms a seal to prevent fluid within the ink container 12 from passing between the sealing member 34 and the outwardly extending needle 50 when the ink container 12 is properly inserted into the printer chassis 38. The sealing member 34 will be discussed in more detail with respect to FIGS. 5–7.

In the preferred embodiment, the air inlet 28 associated with the ink container 12 is similar to the fluid outlet 30 except that the additional seal formed by the spring 70 and sealing ball 72 are eliminated. The air inlet 28 associated with the ink container 12 includes a hollow cylindrical boss 76 that extends outward from an ink container chassis 68. The end of the boss 76 toward the chassis 68 opens into a conduit 78 which is in communication with a region between the outer shell 24 and an outer portion of the fluid reservoir 22 for pressurizing the fluid reservoir 22. The sealing member 36 such as compliant septum and a crimp cover 80 form a seal to prevent pressurized air within the ink container 12 from passing between the sealing member 36 and the outwardly extending needle 60 when the ink container 12 is properly inserted into the printer chassis 38.

Figure 5:
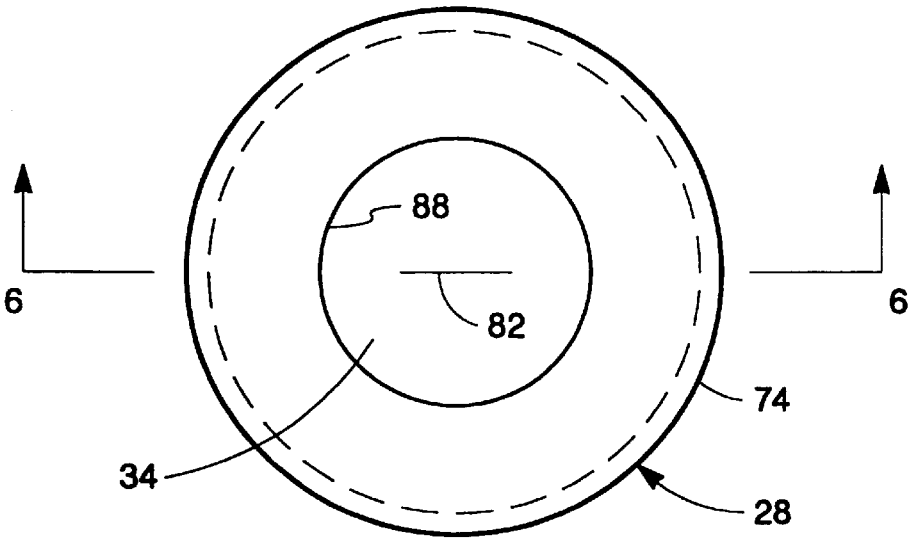
FIG. 5 depicts an end view taken across lines 5—5 of the fluid outlet shown in FIG. 3.
Figure 6:
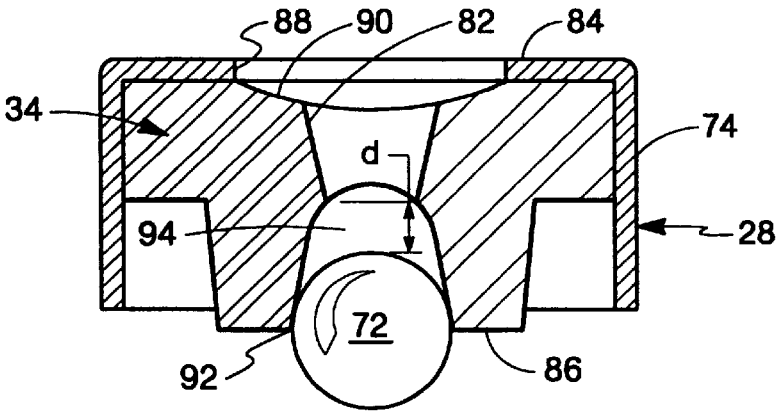
FIG. 6 depicts a section view of the fluid outlet shown in FIG. 5 taken across lines 6—6.

FIGS. 5 and 6 depict greater detail of the sealing member 34 shown in FIG. 4. Sealing member 36 is similar to sealing member 34 and therefore will not be discussed in detail. FIG. 5 depicts an end view taken across lines 5—5 of the fluid outlet 30 shown in FIG. 3. The crimp cap 74 is shown positioned on the sealing member 34. The sealing member 34 includes a slit 82 that is centrally located in the sealing member and extends axially through the sealing member 34. As shown in FIG. 6, the slit 82 is tapered from a leading edge 84 to a trailing edge 86 of the sealing member 34, relative to a direction of insertion into the printer chassis 38. The crimp cap 74 includes an opening 88 for allowing the blunt end of needle 50 to engage slit 82 and penetrate through the sealing member 34 to accomplish fluid communication between the ink container 12 and the printer chassis 38.

A lead-in portion 90 is provided at the leading edge 84 of the sealing member 34 to aid in guiding the blunt end of the needle 50 into the slit 82 in the event of needle 50 misalignment during the insertion of the ink container 12 into the printer chassis 38. In the preferred embodiment, the lead-in portion 90 is concave or bowl-shaped to guide the needle 50 to the slit 82. The lead-in portion 90 may be a variety of other shapes each of which tend to guide the needle 50 to the slit 82. In the preferred embodiment a lubricant is disposed within this lead-in portion 90. The lubricant is a suitable lubricant for reducing friction between the blunt end of the needle 50 and the lead-in portion 90 of the sealing member 34 to minimize or eliminate damage such as ripping or tearing of the sealing member 34 during insertion of the needle 50 through the slit 82. In the preferred embodiment, the lubricant is poly(ethylene glycol) PEG 400.

The sealing member 34 seals the ink container 12 when the needle 50 is removed from the sealing member 34. Therefore, it is important that the sealing member 34 be under compression so that the sealing member 34 creep shut to seal the slit 82 in the sealing member 34. This compression is accomplished by a compressive fit between the sealing member 34 and the crimp cap 74. In addition, it is important that the sealing member material have sufficient resiliency to spring back quickly to seal the slit 82 such that ink leakage is minimized or eliminated when the ink container 12 is removed from the printer chassis 38.

The slit 82 in the preferred embodiment is tapered to form a well-defined seal area between the sealing member 34 and the needle 50. The slit may be a variety of other shapes such as an hourglass shape or some other contour which provides a small sealing area that provides a well controlled contact point between the sealing member 34 and the needle. In addition, it is important that the contour of the slit 82 deflect in a controlled manner as the needle 50 is inserted to provide a well controlled force about the contact point between the sealing member 34 and needle 50 to minimize ink leakage between the needle 50 and the sealing member 34. Although the embodiment shown in FIG. 5 makes use of a contoured slit to achieve a well controlled sealing surface alternatively the sealing member 34 adjacent the needle 50 can be contoured to form a well controlled sealing surface. For example, a sealing surface adjacent the needle 50 can have an hourglass shaped cross-section that thickens radially from the central axis.

In the preferred embodiment, a secondary seal is provided to eliminate or reduce fluid leakage when the needle 50 is removed from the sealing member 34. This secondary seal is provided by a sealing member 72 such as a sealing ball that is biased against a complementary shaped sealing surface 92 at the trailing edge 86 of the sealing member 34. The sealing surface 92 is contoured to provide a well-defined sealing surface with the sealing member 72. In the preferred embodiment the sealing member 72 is biased towards the sealing surface 92 when the needle 50 is removed from the sealing member 34. Upon insertion of the needle 50 into the sealing member 34 the blunt end of the needle 50 engages the sealing member 72 and displaces it from the sealing surface 92 allowing fluid to pass between the ink container 12 and the printer chassis 38.

An important aspect of the sealing member 34 of the present invention is that the sealing member 72 should be spaced from the slit 82. The spacing between the sealing member 72 and the slit 82 having sealing surfaces is represented by a distance d in FIG. 6. To Applicant's surprise, if the spacing represented by distance d is not sufficient the sealing member 72 is prevented from properly engaging the sealing surface 92 because of debris dislodged from the slit 82 which prevent the sealing ball 72 from properly engaging the sealing surface 92. Applicant discovered that repeated insertions and removals of the needle 50 through the slit 82 tends to erode or tear portions of the sealing member 34 which tend to accumulate in the region 94 between the sealing member 72 and the slit 82. It was discovered that when the spacing represented by distance d between the sealing ball 72 and the slit 82 is insufficient this debris tends to prevent the sealing ball 72 from properly engaging the seal 92 allowing fluid leakage past the secondary seal when the needle 50 is removed. Therefore, it is important that a debris accumulation region 94 be provided that is sufficiently large to allow debris accumulation without interfering with the seating of the sealing member 72 with the sealing surface 92. The size of the debris accumulation region 94 or distance d that is required will in general depend on the erosion characteristics of the sealing member 34 and the degree of frictional forces between the needle 50 and the sealing member 34 during insertion and removal through slit 82.

Figure 7:
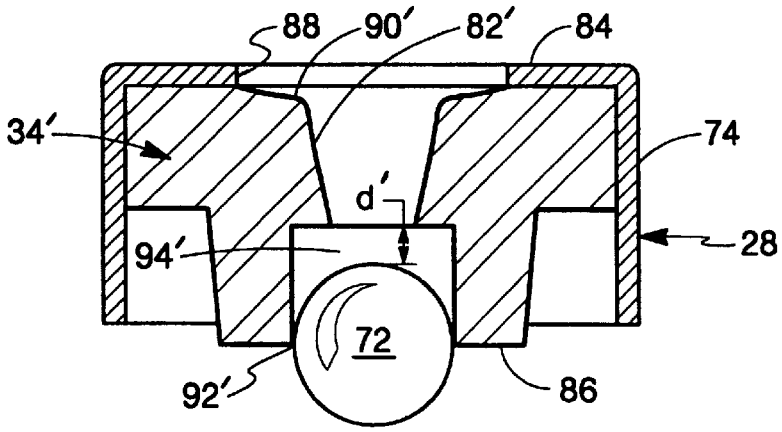
FIG. 7 depicts a section view of an alternative embodiment of the fluid outlet shown in FIG. 6.

FIG. 7 represents an alternative embodiment of the sealing member 34 shown in FIG. 6. Similar numbering is used to represent similar structures. The sealing member 34' shown in FIG. 7 is similar to the sealing member 34 shown in FIG. 6 except for a lead-in 90' is contoured differently from the lead-in 90 shown in FIG. 6. The lead-in 90' is more shallow than the lead-in 90 shown in FIG. 6. In addition, the sealing surface 92' at the secondary seal is contoured differently than the more contoured sealing surface 92 shown in FIG. 6. In addition, this sealing surface 92' is disposed relative to the slit 82' such that with the sealing member 72 positioned to engage the sealing surface 92' a space d' is provided between the slit 82' and the sealing member 72 to accommodate debris or particles dislodged from the sealing member 34'.

It is critical that ink leakage from the ink container 12 be reduced or eliminated both when the ink container 12 is inserted into the printer chassis 38 as well as when the ink container 12 is removed from the printer chassis 38. Ink leakage from the ink container 12 when installed in the printer chassis 38 can damage the printer. In addition, ink leakage during storage and transportation of the ink container 12 is unacceptable for the printer user.

What is claimed is:

1. An ink container for providing ink to an ink jet printing system, the ink container having a fluid outlet for fluidically communicating with a fluid inlet of the ink jet printing system, the fluid inlet having a hollow needle having a blunt end and a lateral hole, the ink container including:

a resilient body member at the fluid outlet, the resilient body member including:

a first sealing surface for tightly receiving the hollow needle to prevent fluid passage between an outer surface of the hollow needle and the first sealing surface when the ink container is in fluid communication with the ink jet printing system, the first sealing surface having a leading edge and a trailing edge relative to a direction of insertion of the hollow tubular member into the first sealing surface;

a second sealing surface for receiving a movable sealing member, wherein the movable sealing member is biased against the second sealing surface when the hollow needle is at least partially removed from the first sealing surface; and a debris accumulation region at the trailing edge of the first sealing surface, wherein the debris accumulation region sufficiently spaces the second sealing surface and thereby the movable sealing member from the trailing edge of the first sealing surface so that the movable sealing member does not contact the trailing edge of the first sealing surface and debris resulting from movement of the hollow needle relative to the first sealing surface accumulates within the debris accumulation region and does not prevent the movable sealing member from seating with the second sealing surface.

2. The ink container of claim 1 wherein the first sealing surface is a preformed slit in the resilient body member.

3. The ink container of claim 1 wherein the leading edge of the first sealing surface includes a concave shaped lead-in portion for guiding the blunt end of the hollow needle toward the first sealing surface during insertion of the hollow needle into the first sealing surface.

4. The ink container of claim 3 wherein the concave shaped lead-in portion contains a lubricant to reduce friction between the hollow needle and the first sealing surface during insertion of the hollow needle through the first sealing surface.

5. The ink container of claim 1 wherein the movable sealing member is spherical and wherein the second sealing surface has a shape that is complementary to the movable sealing member.

6. The ink container of claim 1 wherein the ink container fluid outlet has a central axis and wherein each of the first and second sealing surfaces are disposed along the central axis.

* * * * *

UNITED STATES PATENT AND TRADEMARK OFFICE

CERTIFICATE OF CORRECTION

PATENT NO. : 6,299,296 B2
DATED : October 9, 2001
INVENTOR(S) : Eric L. Gasvoda

It is certified that error appears in the above-identified patent and that said Letters Patent is hereby corrected as shown below:

Title page,
Item [56], References Cited, U.S. PATENT DOCUMENTS, reference was inadvertently omitted. Please insert
-- 5,135,489 8/1992 Jepson et al……..604/48 --;
FOREIGN PATENT DOCUMENTS, reference was inadvertently omitted. Please insert -- G 94 05 723.0 7/1994 (DE)……. --;

Signed and Sealed this

Seventeenth Day of September, 2002

*Attest:*

*Attesting Officer*

JAMES E. ROGAN
*Director of the United States Patent and Trademark Office*